US008132632B2

(12) United States Patent
Scott

(10) Patent No.: US 8,132,632 B2
(45) Date of Patent: Mar. 13, 2012

(54) METHOD FOR RECOVERING VALUABLE DRILLING MUD MATERIALS USING A BINARY FLUID

(75) Inventor: Paul D. Scott, Houston, TX (US)

(73) Assignee: ConocoPhillips Company, Houston, TX (US)

( * ) Notice: Subject to any disclaimer, the term of this patent is extended or adjusted under 35 U.S.C. 154(b) by 257 days.

(21) Appl. No.: 12/425,985

(22) Filed: Apr. 17, 2009

(65) Prior Publication Data

US 2009/0260886 A1 Oct. 22, 2009

Related U.S. Application Data

(60) Provisional application No. 61/046,092, filed on Apr. 18, 2008.

(51) Int. Cl.
*E21B 21/01* (2006.01)
*E21B 21/06* (2006.01)

(52) U.S. Cl. ..... 175/66; 175/206; 175/207; 210/767

(58) Field of Classification Search ..... 175/66, 175/206, 207; 210/767, 787, 800
See application file for complete search history.

(56) References Cited

U.S. PATENT DOCUMENTS

| | | | | |
|---|---|---|---|---|
| 2,870,990 | A * | 1/1959 | Bergey | 175/66 |
| 2,886,287 | A * | 5/1959 | Croley | 175/206 |
| 3,039,545 | A * | 6/1962 | Rogers | 175/66 |
| 4,116,288 | A * | 9/1978 | Love | 175/66 |
| 5,180,020 | A | 1/1993 | Fuh et al. | |
| 5,207,282 | A | 5/1993 | Fuh et al. | |
| 5,211,250 | A | 5/1993 | Kubena, Jr. et al. | |
| 5,944,195 | A * | 8/1999 | Huang et al. | 209/39 |
| 5,996,484 | A * | 12/1999 | Reddoch | 175/66 |
| 6,550,552 | B1 * | 4/2003 | Pappa et al. | 175/66 |
| 6,607,659 | B2 * | 8/2003 | Hensley et al. | 210/87 |
| RE38,367 | E | 12/2003 | Southall | |
| 6,823,238 | B1 * | 11/2004 | Hensley et al. | 700/273 |
| 6,892,887 | B2 | 5/2005 | Rayborn | |
| 6,953,097 | B2 | 10/2005 | Seyffert | |
| 7,438,142 | B2 * | 10/2008 | Butler et al. | 175/66 |
| 2007/0221411 | A1 * | 9/2007 | Butler et al. | 175/66 |

OTHER PUBLICATIONS

Chapter 14, Lost Circulation, pp. 14.1-14.27, Mar. 31, 1998.

* cited by examiner

*Primary Examiner* — George Suchfield
(74) *Attorney, Agent, or Firm* — ConocoPhillips Company

(57) ABSTRACT

This invention relates to a system and process for recovering and recycling valuable target recycle materials such lost circulation material and weighting agents from drilling fluid used in hydrocarbon drilling operations. The system and process includes use of a binary fluid that is separate from the drilling fluid and has a designed density that allows separation of the valuable target recycle materials from drill cuttings. The solids are separated from the drilling fluid in a primary separation step and then mixed with the binary fluid in a density separation or enhanced mass separation device. The binary fluid density allows the separation device to distinguish the target recycle material from drilling solids and recycles the target material to the drilling operations for reuse in drilling fluid. The binary fluid is recovered and refreshed to maintain a generally continuous process of targeted recycling.

20 Claims, 4 Drawing Sheets

METHOD FOR RECOVERING VALUABLE DRILLING MUD MATERIALS USING A BINARY FLUID

CROSS-REFERENCE TO RELATED APPLICATIONS

The present application claims priority to U.S. Provisional Application No. 61/046,092, filed Apr. 18, 2008.

STATEMENT REGARDING FEDERALLY SPONSORED RESEARCH OR DEVELOPMENT

None.

FIELD OF THE INVENTION

The disclosure relates generally to systems and methods for recovery and recycling of solids from drilling muds for use in drilling operations.

BACKGROUND OF THE INVENTION

Drilling fluids, also commonly referred to as drilling mud or drilling muds, have been used for many years and provide a number of benefits for drilling. Drilling fluids are directed through the hollow axis of the drillstring to lubricate and cool the drill bit at the bottom of the well. The drilling fluids return to the surface in the annulus between the drillstring and the interior wall of the drillstring carrying drill cuttings (rocks, sand, shale, grit and other debris) back to the surface. At the surface, drilling fluids are processed to remove drill cuttings and undesirable drill solids, then recirculated into the well. Another function of the drilling fluids is attained by the addition of loss circulation materials sometimes referred to by the letters "LCM" or loss prevention materials, also referred by the letters "LPM". The function of the LCM is to seal porous and permeable or naturally fractured formations and to arrest hydraulic fracturing of formations, preventing the drilling mud from leaking away from the wellbore which is a condition called "lost circulation". The function of the LPM is to prevent or significantly limit hydraulic fracturing of the formation to the near wellbore region to create a stronger wellbore, this application of LPM is referred to as wellbore strengthening which prevents the drilling mud from leaking away from the wellbore. It should be noted that LCM/LPM does not dissolve or react with the drilling mud and generally comprises solid granular, fibrous, or flake-like materials that are able to form plugs by the accumulation of many individual LCM/LPM particles. Wellbore strengthening and lost circulation remedies using LCM/LPM may not be fully utilized because it is impractical to recover and recycle the materials used to in these operations and also to process the drilling fluid to remove the drill cuttings and undesirable drill solids. Typically, screening operations may be bypassed to retain the wellbore strengthening and lost circulation materials for a period of time such that normal processing to remove drill cuttings and undesirable drill solids cannot be utilized or the LCM/LPM is used for only a single pass through the well then removed and discarded at the surface.

In addition to the functions described above, drilling fluids also often include other materials, sometimes called "weighting agents" that alter the density of the mud and most commonly increase the density of the drilling mud to maintain substantial head pressure in the wellbore. Maintaining substantial head pressure is also called "well control" and well control basically means drilling and completing the well while maintaining head pressure that avoids a "blowout" or "kick". A blow out or kick primarily occurs when the pressure exerted on the walls of the wellbore becomes less than the pressure a fluid in a high pressure formation that has been penetrated by the wellbore. Blow outs and kicks are very dangerous and destructive. Weighting agents are finely ground materials which make the removal of fine drill solids by processing equipment such as hydrocyclones and rotating centrifuges considerably less efficient. Often both well control and lost circulation control are needed in the same interval such that drilling fluids have both a weighting agent and loss circulation materials to maintain a substantial volume of dense drilling fluid in the wellbore at all times.

In conventional drilling operations, the drilling fluids are recirculated after being processed to remove the drill cuttings and other undesirable solids from the fluid. Typically, the separation of larger drill cuttings is done based on size with a screened shale shaker and smaller solids may be partially removed by additional processing equipment such as hydrocyclones or rotating centrifuges which work based on the mass of a particle. As the LCM/LPM materials and weighting agents are solids, they interfere with the efficient removal of drill cuttings and other undesirable solids because the particles have similar size or mass. Since such materials have not been very expensive, there has been little incentive to consider ways to recover or recycle these materials. However, advances in wellbore strengthening technology, improved LPM materials and an increasingly limited supply of quality weighting materials has created the need for improved methods for the recovery and recycling for drilling fluids materials. At the same time, petroleum drilling operations in remote areas makes disposable materials more expensive when one considers the logistical costs of shipping such materials and maintaining large inventories of the same, particular in offshore or small worksite locations.

SUMMARY OF THE INVENTION

The present invention provides a system for recovering target recycle materials from drilling fluid provided by a hydrocarbon well drilling operation where the drilling fluid also carries a substantial volume of various sized solid drill cuttings and the target recycle materials are used in drilling fluid to achieve a desired function and the target recycle materials are solids that are not easily separated from the drill cuttings. The system comprises an arrangement including a primary separation device arranged to separate used drilling fluid that contains drilling solids and target recycle materials into at least two streams where one stream comprises primarily liquids and the other stream comprises primarily solids. The system further includes a binary separation device having an inlet for the solids stream and arranged to separate solids based on density where there are at least two outlets where a first outlet is arranged to deliver materials having a lighter density material and a second outlet arranged to deliver materials having a greater density. A binary fluid is included with the binary separation device and where the binary fluid is separate and distinct from the drilling fluid and wherein the binary fluid has a selected design density range that is between the densities of the target recycle material and the drill cuttings or close to the density of one of the two solids that are intended to be separated. The solids stream is blended with the binary fluid and the binary fluid operates to separate the target recycle materials from the cutting materials so that the respective materials are directed to the respective outlets of the binary separation device. A first solid/liquid separation device is arranged for separating target recycle material from the binary fluid after exiting the binary separation device and a second solid/liquid separation device is arranged for separating the non-target solid drill cuttings from the binary fluid after exiting the binary separation device.

The invention preferably includes a rejuvenator for the binary fluid to eliminate contaminants and diluents and direct rejuvenated binary fluid to the binary separation device having a density within the design density range.

The invention also comprises a process for recovering target recycle materials from drilling fluid provided by a hydrocarbon well drilling operation where the drilling fluid also carries a substantial volume of various sized drill cuttings and the target recycle materials are used in drilling fluid to achieve a desired function and the target recycle materials are solids that are not easily separated from the drill cuttings. The process of recovering the target recycle material includes a number of steps including separating drilling fluid recovered from wellbore drilling to produce at least one solids stream and a liquid stream, wherein the solids stream includes a substantial amount of the target recycle material and an amount of non-target solid drill cuttings. The solids stream is blended with a binary fluid to form a density separation fluid where the binary fluid is separate and distinct from the drilling fluid and has a selected design density range that provides gravity separation based on density or enhanced mass separation. The target recycle materials are separated from the non-target solids in a binary separation step based on density or enhanced mass separation. The target recycle materials are directed to a liquid/solid separation step to recover the target recycle materials and direct collected binary fluid to recycle back to the binary separation step. The non-target solids are directed to a liquid/solid separation step to eliminate the non-target recycle materials and the collected binary fluid is directed back to the binary separation step.

The process preferably includes rejuvenating the binary fluid to eliminate contaminants and diluents from the solid/liquid separation steps and direct the rejuvenated binary fluid to the binary separation device having a density within the design density range.

In a particular embodiment of the present invention, a process is provided for recovering first low density target recycle materials and second high density target recycle materials from drilling fluid provided by a hydrocarbon well drilling operation where drilling fluid also carries a substantial volume of various sized solid drill cuttings where the target recycle materials are used in drilling fluid to achieve desired functions and the target recycle materials are solids that are not easily separated from drill cuttings. The process of recovering both target recycle materials includes separating drilling fluid recovered from wellbore drilling to produce a first solids stream, a second solids stream and a third stream comprising primarily liquids. The first solids stream comprises primarily first target recycle material along with solid drill cuttings of larger physical size. The second solids stream comprises primarily second target recycle material along with drill cuttings of a smaller physical size. Each of the first and second streams comprise a substantial amount of the target recycle material and a substantial amount of non-target solid drill cuttings that will be further processed while the third stream is directed back to the drilling operation for eventual re-use. The process of recovering low density target recycle materials further includes the blending of the first solids stream with a first binary fluid to form a first density separation fluid where the first binary fluid is separate and distinct from the drilling fluid and has a design density that is close to or between the densities of the drill cuttings and the first target recycle material and provides for gravity separation or enhance mass separation. The first target recycle materials are separated from the non-target solid drill cuttings in a first binary separation step based on density and the first target recycle materials are directed to a first liquid/solid separation step to recover the first target recycle materials and direct collected first binary fluid to a first binary fluid rejuvenation step. The non-target drill cuttings are directed from the first binary separation step to a second liquid/solid separation step to eliminate the non-solid drill cuttings and direct collected binary fluid to the first binary fluid rejuvenation step. The first binary fluid is rejuvenated in the first binary fluid rejuvenation step to eliminate contaminants and diluents and direct rejuvenated first binary fluid to the first binary separation step having a density within the design density range. The second solids stream is blended with a second binary fluid to form a second density separation fluid where the second binary fluid is separate and distinct from the drilling fluid and has a design density that is close to or between the densities of the drill cuttings and the second target recycle material to provide for gravity separation or enhance mass separation. The second target recycle materials are separated from the non-target solid drill cuttings in a second binary separation step based on density. The second target recycle materials are directed to a third liquid/solid separation step to recover the second target recycle materials and direct collected second binary fluid to a second binary fluid rejuvenation step and the non-target drill cuttings are directed from the second binary separation step to a fourth liquid/solid separation step to eliminate the non-target solid drill cuttings and direct collected second binary fluid to the second binary fluid rejuvenation step. The second binary fluid is rejuvenated to eliminate contaminants and diluents and direct rejuvenated second binary fluid to the second binary separation step having a density within the design density range.

BRIEF DESCRIPTION OF THE DRAWINGS

The invention may best be understood by reference to the following description taken in conjunction with the accompanying drawings in which.

DETAILED DESCRIPTION OF THE INVENTION

Turning now to the preferred arrangement for the present invention, reference is made to the drawings to enable a more clear understanding of the invention. However, it is to be understood that the inventive features and concept may be manifested in other arrangements and that the scope of the invention is not limited to the embodiments described or illustrated. The scope of the invention is intended only to be limited by the scope of the claims that follow.

Figure 1:
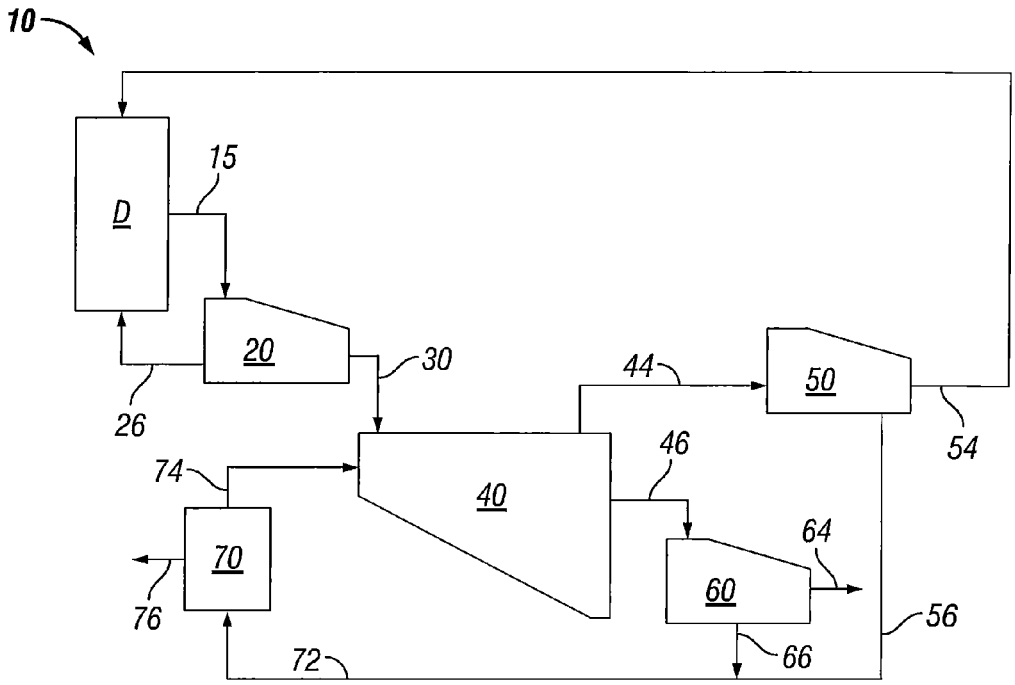
FIG. 1 is a schematic drawing of a first embodiment of the current invention where the target recycle material is less dense than the drill cuttings and a gravity separation device, such as a settling tank with a binary fluid is used for density separation.

Referring initially to FIG. 1 which is a process flow diagram illustrating a first embodiment of a separation and recovery process generally indicated by the arrow 10 for removing solids from drilling fluid that has emerged from a wellbore with drill cuttings and similar materials derived from the hydrocarbon well drilling process. Once the solids are removed from the drilling fluid, the drilling fluid is directed to the drilling operation where it may be prepared for re-use. In the separation process 10, a drilling operation D captures the drilling fluid that has circulated through the well and come up from the drill bit along the annulus of the well. As described above, this "laden" drilling fluid includes solid drill cuttings of various sizes from sand and grit to substantial bits of rock. The drilling fluid also includes additives for lubricity, density and other useful functions of the drilling fluid. Some additives are solids such as LCM/LPM, and others may be weighting agents and each may be sufficiently valuable to recover from the drilling fluid and separated from the drill cuttings. The laden drilling fluid enters the separation process via conduit 15.

Conduit 15 carries the laden drilling fluid into a primary separation device 20, such as a shale shaker, which includes a screen separator to create two outflow streams where one comprises solids and the other comprises liquid. The first outflow stream exits via conduit 26 which is the substantially cleaned liquid via conduit 26. The cleaned liquid is substantially free of solids, or at least solids that are bigger than the openings of a small mesh screen and can now be processed for recycling. The cleaned drilling fluid is recycled for use in the drilling operation D, as is conventional. The solids are collected from the upper surfaces of the mesh screens in the primary separation device 20 which include the target recycle materials along with drill cuttings and other particles of similar size and carried out via conduit 30.

In a more preferred embodiment, the solids stream itself may be separated into two streams where a first solids stream comprising the larger solids and a second solids stream comprising solids that are smaller than the solids in the first solids stream uses shale shaker equipment with staged screens of differing mesh sizes to provide several streams of size-sorted solids. In this arrangement, the target recycle materials will primarily reside with the second solids stream with the smaller solids. The first stream comprises the large drill cuttings and particles that are too large to pass through the openings of the first screen or screens and would be directed to a conventional cuttings disposal system. The second stream of solids which are smaller in size compared to the first stream may be separated from drilling fluid using a screen system with smaller mesh sizes or higher number mesh sizes or employ a centrifugal separation system, such as a hydrocyclone or a rotary centrifuge. Also, the primary separation device 20 in FIG. 1 may select from a number of particle sorting devices including a hydrocyclone.

In an embodiment where the target recycle materials are specially selected loss circulation materials, the LCM is will be less dense than the drill cuttings. Conduit 30 is connected to a binary fluid gravity separator 40 that includes a tank substantially full of a binary fluid that is distinct from the drilling fluid and that is non-reactive with the materials entering the separator 40. The binary fluid has a selected design density range that is between the densities of the target recycle material and the drill cuttings or close to the density of one of the two solids that are intended to be separated that may be directed into conduit 30. What the inventor has found is that the target materials will stay suspended or rise to the surface of the tank of binary fluid within separator 40 while the drill cuttings settle to the bottom thereof if a binary fluid is provided that is between the densities of the drill cuttings and the target materials or near to the same as one of the densities, the solids are continuously separated based on density. If the binary fluid is close, either the denser materials will settle out and the lighter will stay in suspension or the lighter materials will float to the surface and the denser will stay in suspension. Either way, the materials can be effectively separated.

The target recycle materials are collected from the binary fluid or near the fluid surface in binary fluid separator 40 and directed to a solid/liquid separator 50 via conduit 44 where the solids are separated from the binary fluid. The target recycle solids are recycled back into the drilling operation D via conduit 54 to be added to the drilling fluid at a prescribed rate for loss control. The binary fluid is conveyed via conduit 56 for re-use in the binary fluid separator 40. It should be noted that the target recycle materials may be re-used in the drilling operation directly or may be collected for future use in a separated drilling operation. In the latter circumstance, further processing of the now collected target recycle material may be performed.

While the first embodiment uses a settling tank, there are many other suitable gravity separation devices that would also be suitable such as, for example, an inclined plate tank.

The drill cuttings are collected at the bottom of the binary fluid separator 40 and directed to a second solid/liquid separator 60 where the drill cuttings are rejected at conduit 64 and the binary fluid is recycled to the binary fluid separator 40. Since the density of binary fluid is important for the separation of the target materials from the non-target materials, a binary fluid rejuvenator 70 may process the recycled binary fluids from separators 50 and 60 via conduits 56 and 66 and also via conduit 72 and deliver design density binary fluid to the binary fluid separator 40. The binary fluid rejuvenator process may be an integral part of the binary fluid process or may be a batch treatment where two volumes of binary fluid are maintained and the binary fluid is rejuvenated on a periodic basis in a separate process. Contaminants including fine to intermediate sized drill cuttings and other undesirable solids are rejected via conduit 76. It should be noted that some particles may pass from primary separator 20 with the solids into binary separator 40 and be separated from the binary fluid in rejuvenator 70.

Solid/liquid separators are conventional devices, per se, and many different technologies may be used in the inventive process and system. Examples of suitable equipment include shale shaker-type screens, filter presses, belt presses, rotary centrifuges, hydrocyclones and many other known devices that simply separate liquids from solids.

To provide some perspective on the separation that is being accomplished in the system 10 in the preferred embodiment, where the primary separator 20 provides two streams of solids, the primary separator 20 will reject the particles that are generally larger than 150 to 2500 microns, depending on the target recycle material size and permit particles that are similar in size to the target recycle material to be directed to binary separator 40. Drilling fluid and very fine solids are returned to the conventional drilling operation substantially without the target recycle materials and the drill cuttings of similar and larger sizes so that the drilling fluid can be processed in the normal manner to further remove additional fine drill solids allowing for a more efficient operation.

The primary separating device 20 may be any device which is suitable to separate the particles mixed in the used drilling fluid as described above, such as a shale shake or mud cleaner. In one embodiment, the primary separating device will be one or more shale shakers that have multiple screens for particle separation. The screen size of the larger screens on the shale shaker are preferably from about 5 to about 200 mesh, depending on the size of the target recycle material, with the finer screen preferably from about 20 to about 300 mesh. Or, several screens may have differing mesh sizes where the first screen has a screen size of from about five to about 200 mesh, the second screen having a screen size from about 20 to about 300 mesh, depending on the size of the target material.

Figure 2:
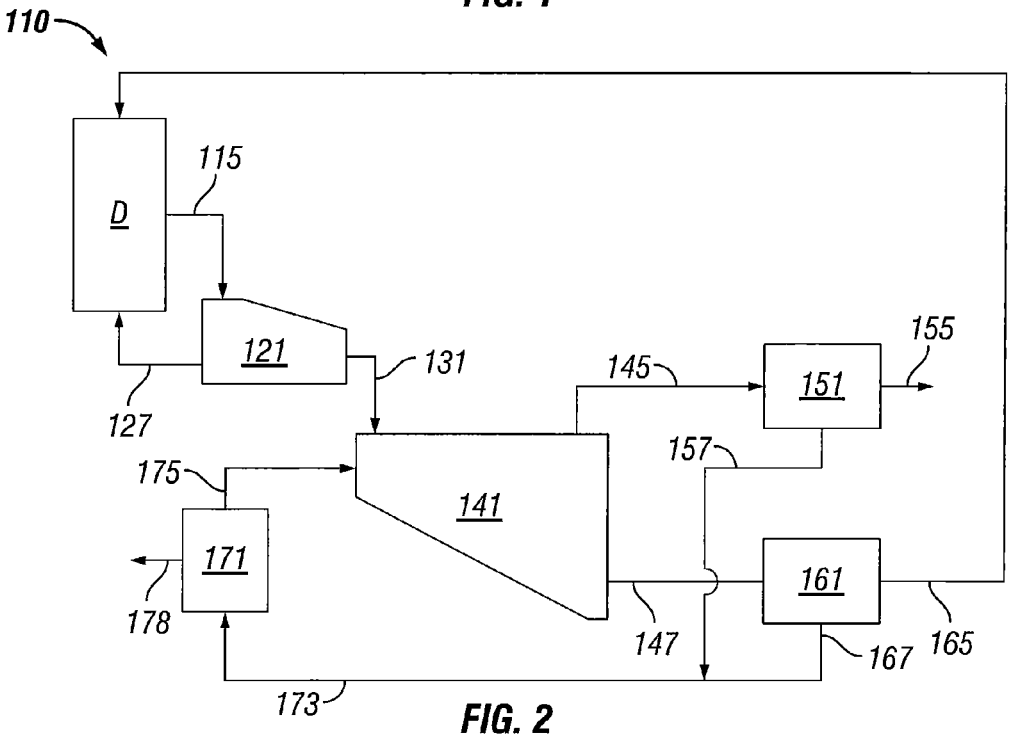
FIG. 2 is a schematic drawing of an embodiment of the current invention where the target recycle material is more dense than the drill cuttings and a gravity separation device, such as a settling tank with a binary fluid is used for density separation.

In FIG. 2, a separation process 110 is illustrated for recovering target materials that are more dense than the drill cuttings. Such materials may include very dense additives for creating extra dense drilling fluid for overbalance well control. This function is sometimes referred to as a weighting agent. Weight materials are usually much smaller particles than other target recycle materials. The system and process are similar to the numbering system in FIG. 1, the system 110 includes elements with similar function and uses similar or the same numbers with the addition of a "1" in the hundreds position. For example, the conduit to carry the drilling mud from the drilling operation in FIG. 2 is conduit 115 where the same conduit is 15 in FIG. 1.

Like the previous embodiment, the laden drilling fluid enters the separation process 110 via conduit 115 from the drilling operation D. In this embodiment due to the small particle size of the weighing material, the primary separation device 121 is a centrifugal separation device, such as a decanting rotary centrifuge (shown) or a hydrocyclone mud cleaner. The dense target recycle material is primarily expected to exit the primary separation device 121 via conduit 131 with other particles of similar mass. Conduit 131 is connected to a binary fluid separator 141 that includes a tank substantially full of a binary fluid that is distinct from the drilling fluid that is non-reactive with the materials entering the separator 141. The binary fluid is selected with a design density range that is between the densities of the target recycle material and the drill cuttings or close to the density of one of the two solids that are intended to be separated. This allows the non-target materials to be directed into conduit 145. As the non-target materials stay in suspension within binary fluid separator while the target materials settle to the bottom thereof, the binary fluid separator 141 continuously separates the solids based on density. The target recycle materials are collected near the bottom of binary fluid separator 141 and directed to a solid/liquid separator 161 via conduit 147 where the solids are separated from the liquid.

The target materials are separated from the binary fluid separator 141 and directed to a solid/liquid separator 161. Since the target recycle materials are the extra dense materials, the solids from separator 161 are recycled back into the drilling operation D via conduit 165 to be added to the drilling fluid at a prescribed rate for well control and increasing density of the drilling fluid. The binary fluid is carried via conduits 167 and 173 for re-use in the binary fluid separator 141.

The suspended drill cuttings or non-target solids are separated from the binary fluid separator 141 and directed to a second solid/liquid separator 151 where the drill cuttings are rejected at conduit 155 and the binary fluid is recycled to the binary fluid separator 141 via conduits 157 and 173. As in the system of FIG. 1, a binary fluid rejuvenator 171 is used to process the recycled binary fluids from separators 151 and 161 via conduit 173 and deliver design density binary fluid to the binary fluid separator 141 within a prescribed range. Contaminants including drilling fluid and particles are rejected via conduit 178.

Figure 3:
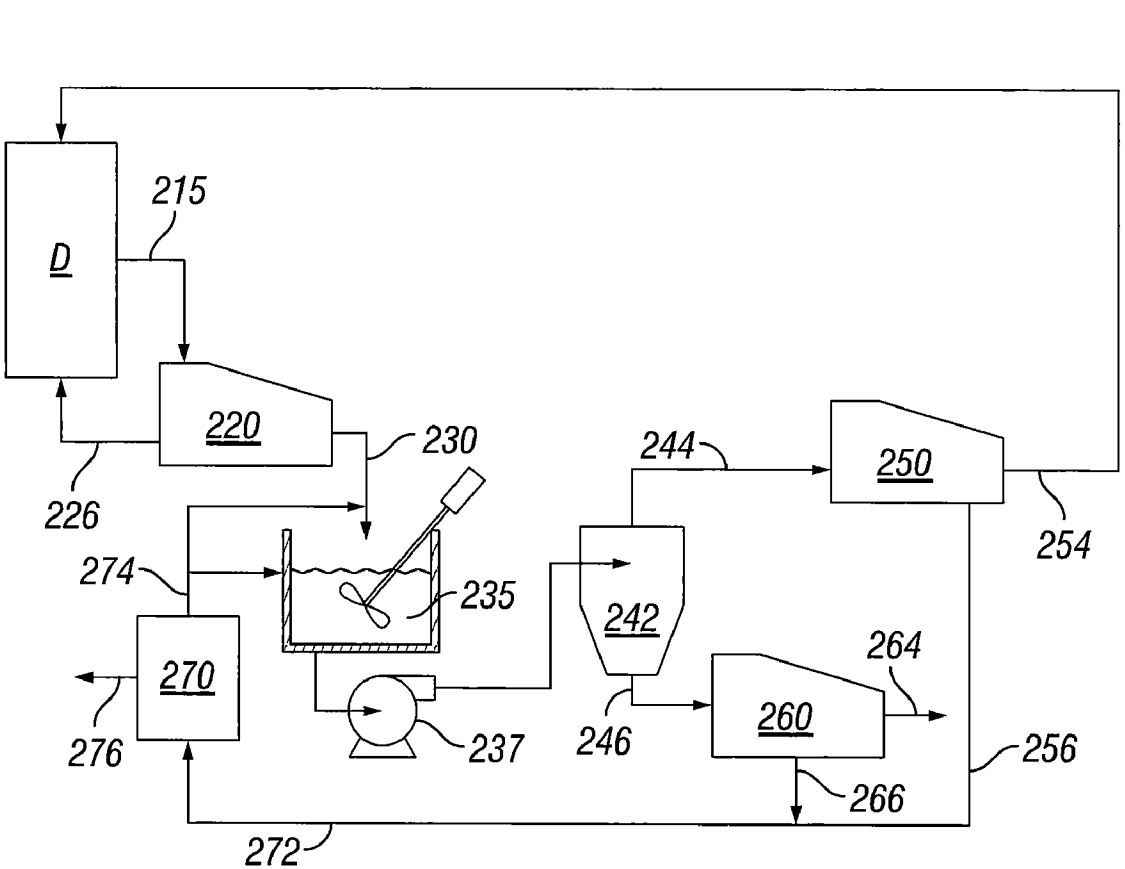
FIG. 3 is a schematic drawing of an embodiment of the current invention where the target recycle material is less dense than the drill cuttings and a binary fluid with a centrifugal separation device, such as a hydrocyclone or rotary centrifuge, is used for density separation.

The system and process illustrated in FIG. 3 is very similar to the system and process illustrated in FIG. 1 with the primary difference that a centrifugal separation device 242, such as a hydrocyclone or rotary centrifuge, is used to separate the lighter density target recycle materials from the denser drill cuttings. A separation device, using centripetal force, can exert many times the gravity separation force as a settling tank separator such as illustrated at 40 in FIG. 1. A stirred tank 235 receives the target recycle material and the intermediate drill cuttings via conduit 230 and binary fluid from binary fluid rejuvenator 270 to create a binary fluid slurry. The slurry is pumped into hydrocyclone 242 by pump 236 through a tangential inlet to create a high speed vortex, as is known. The lighter materials stay in suspension with the binary fluid stream, while the denser undesirable drill solids are discharged from the separation device at conduit 246.

In this embodiment where a hydrocyclone or other centrifugal force separating device is used, the binary fluid becomes more critical to the invention as hydrocyclones tend to separate solids based on mass and not density. Without the sorting based on density which is achieved with the binary fluid, one would expect to get a blend of particles having a lower mass exit at one outlet while particles of higher mass exit the other outlet. Each blend may have a significant population of more dense and less dense materials. Perhaps a screen sorter may be employed on each stream as the less dense particles will be larger than the smaller, denser particles of similar mass, but this alternative is not preferred. It is when a binary fluid having a density near or between the two types of solids that are intended and desired to be separated that the particles with a density close to the binary fluid are retained in the binary fluid and the more dense particles are rejected from the binary fluid. A true density separation or enhanced mass separation is achieved and used for the present invention in both gravity separation and in centrifugal separation by the use of the described binary fluid.

Figure 4:
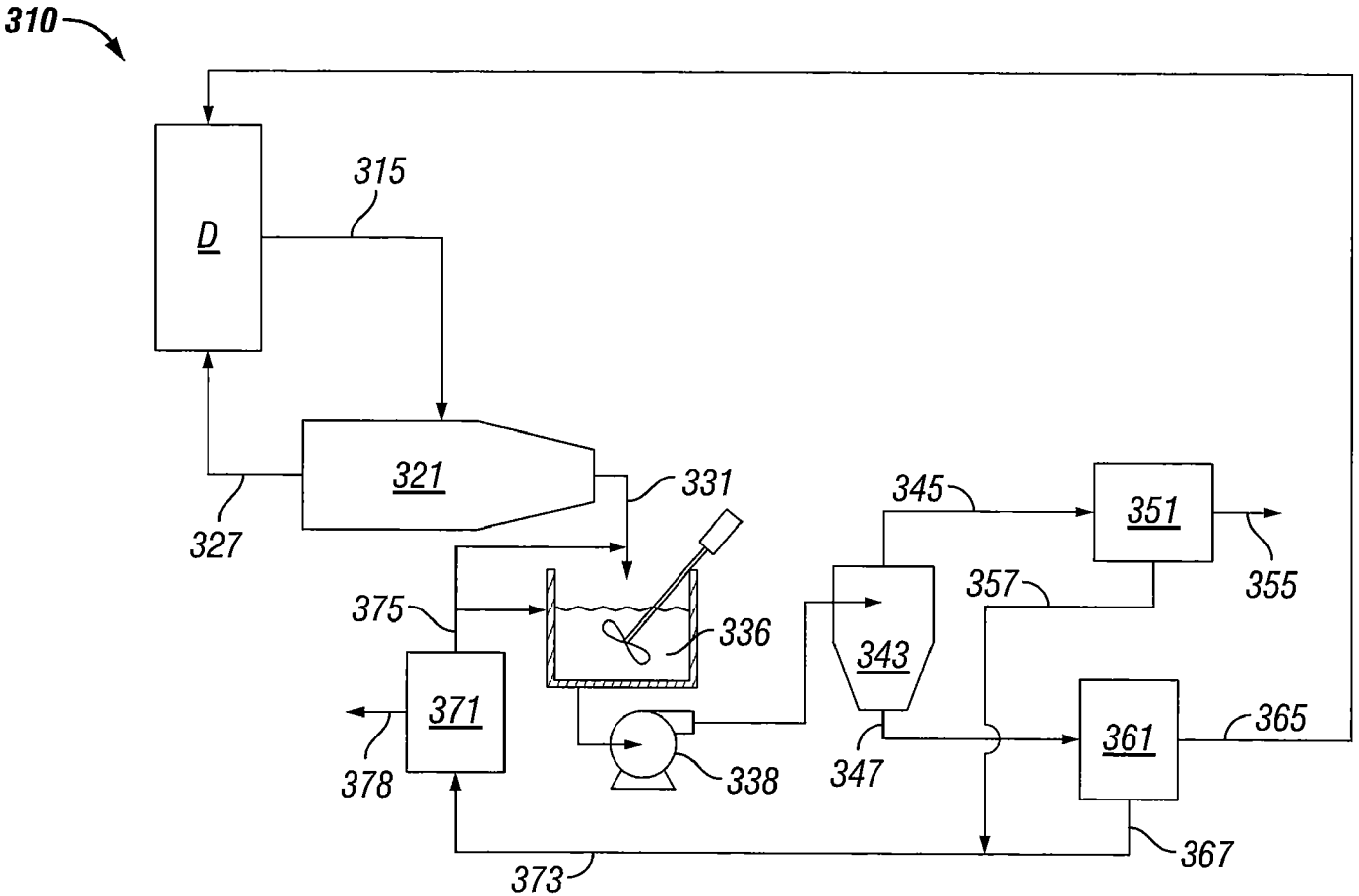
FIG. 4 is a schematic drawing of an embodiment of the current invention where the target recycle material is more dense than the drill cuttings and a binary fluid with a centrifugal separation device, such as a hydrocyclone or rotary centrifuge, is used for density separation.

The system and process illustrated in FIG. 4 is very similar to the systems and process illustrated in FIG. 2 and analogous to the system illustrated in FIG. 3. It is similar to the FIG. 2 system and process in that the denser weighting agent is the target recycle material and analogous to the system in FIG. 3 in that it uses a centrifugal separation device 343, such as a hydrocyclone, for density separation or, perhaps more precisely, enhanced mass separation.

Figure 5:
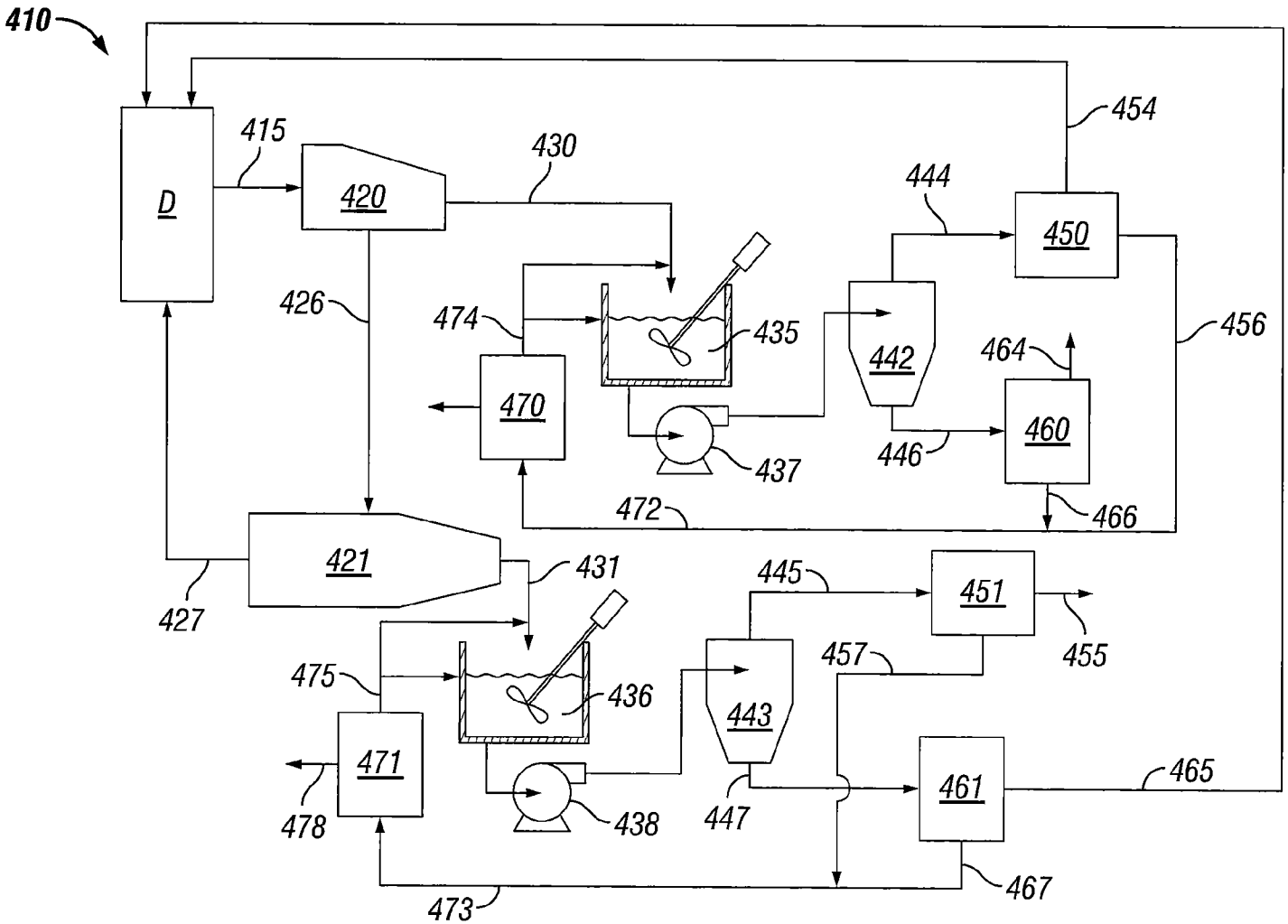
FIG. 5 is a schematic drawing of an embodiment of the current invention where two target recycle materials are present in the drilling fluid where a first target recycle material is less dense than the drill cuttings and the second target recycle material is more dense that the drill cuttings and first and second binary fluids are used to recover and recycle the target recycle materials.

FIG. 5 is an interesting embodiment in that two target recycle materials are collected. Like the previous embodiments, drilling fluid is delivered to the process 410, laden with drill cuttings and target recycle materials via a conduit 415. The laden drilling fluid is delivered into a primary separation device 420, such as a shale shaker, which includes a screen separator to create two outflow streams where one stream comprises solids and the other stream comprises a slurry or a liquid with finer particles. If it has not already been noted, typically the LCM materials have a larger dimension than the weighting agent and tend to be separated from one another based on size-separators. What is more difficult is separating the target recycle materials from drill cuttings which come in all sizes.

The primary separation device 420 provides its first outflow stream to exit via conduit 430 which comprises the solids and the second stream exits via conduit 426 which is the slurry stream or the liquid stream with fine particles blended therein. The slurry in conduit 426 is directed to a decanting rotary centrifuge 421 where the solids are separated into a second solids stream and exits via conduit 431 and the liquid exits via conduit 427 and is directed back to the drilling operation D for re-use.

In this embodiment, each of the solids streams includes a different target recycle material where the target recycle material in the first solids stream is less dense than drill cuttings such as LCM and the second target recycle material in the second recycle stream is more dense than drill cuttings such as a weighting agent. It should be understood that the binary fluid separation may be implemented to recover less dense target materials in the solids of larger size that exits the primary separation device 420 at conduit 430 and, at the same time, recover more dense target materials from the decanting centrifuge 421 that exit via conduit 431. With that understood, the description of the embodiment of FIG. 5 will continue focusing on recovering the first target recycle material in the first solids stream in conduit 430.

The first solids stream is conveyed by conduit 430 to a blending tank 435 having a first binary fluid therein with a selected design density range that is between the densities of the target recycle material and the drill cuttings or close to the density of one of the two solids that are intended to be separated. As described above, the first solids stream is blended with the binary fluid in blending tank 435 which may be stirred to maintain the particles in a slurry for pumping by pump 437 into centrifugal separator 442, which is shown to be a hydrocyclone. The less dense target solids with some of the binary fluid exits the top of the centrifugal separator 442 via conduit 444 which leads to a first solid/liquid separator 450. The solids, now comprising mostly less dense target recycle materials are directed via conduit 454 to the drilling operation D.

The liquids from first solid/liquid separator are recycled to the binary separation but preferably first to a rejuvenator 470 to eliminate contaminants and provide design density primary fluid back to the blending tank 435 for binary separation. The non-target materials from the centrifugal separator 442 are directed via conduit 446 to second solids/liquid separator 460 where the drill cuttings are disposed in conventional manner at conduit 464 and the binary fluid is directed to the rejuvenator 470 via conduits 466 and 472.

The second solids stream that includes the second target recycle material is similarly blended with a second binary fluid. A second parallel binary separation system is provided including second blend tank 436, pump 438 and centrifugal binary separation device 443. The high density target recycle materials are recovered at a solid/liquid separation device 461 and returned to the drilling operation 465. Second binary fluid is returned to the second rejuvenator 471 via conduits 457, 467 and 473.

The binary fluid may be made of a solids free liquid using solutions of sodium chloride, calcium chloride, sodium bromide, calcium bromide, sodium formate, potassium chloride, potassium formate, cesium formate, or any other dense liquid and mixtures of two or more of the foregoing maybe used. On the other hand, the binary fluid may also be formulated with ultra fine particles as a slurry from one or more materials of finely ground barite, micronized barite, manganese tetraoxide (such as MircoMax marketed by Elkem), fine grind or micronized hematite or any other suitable dense solid weighting agent. The binary fluid can be formulated in water, or dense liquids such as the brines listed above, or oils or other compatible liquids. It should be noted that the drill cuttings typically have a density of between 2.0 and 2.8 SG (standard gravity). LCM typically has a density in the range of 0.8 and 2.5 SG. Weighting agents typically have a density in the range of 2.5 and 7.5 SG. It is expected that a system incorporating the present invention will be engineered and "tuned" for each drilling application along with the selection of drilling fluid, LCM, weighting agents and any other solids that might be target recycle materials.

Finally, the scope of protection for this invention is not limited by the description set out above, but is only limited by the claims which follow. That scope of the invention is intended to include all equivalents of the subject matter of the claims. Each and every claim is incorporated into the specification as an embodiment of the present invention. Thus, the claims are part of the description and are a further description and are in addition to the preferred embodiments of the present invention. The discussion of any reference is not an admission that it is prior art to the present invention, especially any reference that may have a publication date after the priority date of this application.

The invention claimed is:

1. A system for recovering target recycle materials from drilling fluid provided by a hydrocarbon well drilling operation where the drilling fluid also carries a substantial volume of various sized solid drill cuttings and the target recycle materials are used in drilling fluid to achieve a desired function and the target recycle materials are solids that are not easily separated from the drill cuttings, the system comprising:

(a) a primary separation device arranged to separate drilling fluid that contains solid drill cuttings and solid target recycle materials into at least two streams where one stream comprises primarily liquid and the other stream comprises primarily solids;

(b) a binary separation device having an inlet for the solids stream and at least two outlets where a first outlet is arranged to deliver materials having a lighter density material and a second outlet arranged to deliver materials having a greater density than the materials that exit the first outlet;

(c) a binary fluid which is separate and distinct from the drilling fluid and located in the separation device, wherein the binary fluid has a selected design density range that is close to or between the densities of the target recycle material and the non-target material, where the solids of the second stream are mixed with the binary fluid and the binary fluid operates to separate the target recycle materials from the non target materials based on density so that the respective materials are directed to the respective outlets of the binary separation device;

(d) a first solid/liquid separation device for separating target recycle material from the binary fluid after exiting the binary separation device;

(e) a second solid/liquid separation device for separating the non-target material from the binary fluid after exiting the binary separation device; and (f) at least one conduit for conveying the binary fluid from at least one of the first and second solid/liquid separation devices and directing the same to the binary separation device.

2. The system according to claim 1 wherein the binary separation device is a gravity separation device, such as a settling tank or inclined plate settler.

3. The system according to claim 1 wherein the binary separation device is a centrifugal separation device, such as a hydrocyclone or rotary centrifuge.

4. The system according to claim 1 wherein the primary separation device separates the target recycle solids from the drilling fluid stream and the system is arranged to direct the target recycle solids to the binary separation system.

5. The system according to claim 1 wherein the binary fluid from both solid liquid separation devices are recycled to the binary separation system.

6. The system according to claim 1 further including a binary fluid rejuvenator for processing the binary fluid for re-use in the binary separation device at the design density.

7. The system according to claim 6 wherein the binary fluid rejuvenator is arranged to provide a continuous supply of rejuvenated binary fluid to the binary separation device.

8. The system according to claim 6 wherein the binary fluid rejuvenator is arranged to periodically provide a replacement volume of binary fluid to the binary separation device in a parallel batch-like process.

9. The system of claim 1 wherein the binary fluid has a specific gravity of in the range of 1.0 to 3.8.

10. A process for recovering target recycle materials from drilling fluid provided by a hydrocarbon well drilling operation where the drilling fluid also carries a substantial volume of various sized solid drill cuttings and the target recycle materials are used in drilling fluid to achieve a desired function and the target recycle materials are solids that are not easily separated from drill cuttings, the process of recovering the target recycle material comprising the steps of:

(a) separating drilling fluid recovered from wellbore drilling to produce at least one solids stream and a liquid stream, wherein the solids stream includes a substantial amount of the target recycle material and an amount of non-target solid drill cuttings;

(b) blending the solids stream with a binary fluid to form a density separation fluid where the binary fluid is separate and distinct from the drilling fluid and has a selected design density range that provides gravity separation based on density or enhanced mass separation;

(c) separating the target recycle materials from the non-target solids in a binary separation step based on density or enhanced mass separation;

(d) directing the target recycle materials to a liquid/solid separation step to recover the target recycle materials and direct collected binary fluid back to the binary separation step; and (e) directing the non-target solids to a liquid/solid separation step for the elimination of the non-target recycle materials and direct collected binary fluid back to the binary separation step.

11. The process according to claim 10 wherein the target recycle materials are lighter in density than the drill cuttings.

12. The process according to claim 10 wherein the target recycle materials are heavier in density than the drill cuttings.

13. The method of claim 12 wherein the binary fluid has a specific gravity of in the range of 1.0 to 3.8.

14. The process according to claim 10 wherein the binary separation step is accomplished in a gravity separation device, such as a settling tank or inclined plate settler.

15. The process according to claim 10 wherein the binary separation step is accomplished in a centrifugal separation device, such as a hydrocyclone or rotary centrifuge.

16. The process according to claim 10 further including the step of rejuvenating the binary fluid to eliminate contaminants and diluents and direct rejuvenated binary fluid to the binary separation step having a density within the selected design density range.

17. The process according to claim 10 wherein rejuvenated binary fluid is arranged to be continually provided to the step of blending.

18. The process according to claim 17 wherein rejuvenated binary fluid is arranged to be continuously provided to the step of blending.

19. The process according to claim 10 wherein rejuvenated binary fluid is arranged to be periodically replaced in the step of blending such that substantially the entire volume of binary fluid is replaced in a parallel batch-like process.

20. A process for recovering first, low density, target recycle materials and second, high density, recycle materials from drilling fluid provided by a hydrocarbon well drilling operation where the drilling fluid also carries a substantial volume of various sized solid drill cuttings and the target recycle materials are used in drilling fluid to achieve a desired function and the target recycle materials are solids that are not easily separated from the drill cuttings, the process of recovering the lost circulation material comprising the steps of:

(a) separating drilling fluid recovered from wellbore drilling to produce a first solids stream comprising primarily first target recycle materials along with solid drill cuttings of larger size, a second solids stream comprising primarily second target recycle material along with drill cuttings of a smaller size and a third stream comprising primarily liquid, wherein each of the first and second streams comprise a substantial amount of the target recycle material and a substantial amount of non-target solid drill cuttings;

(b) blending the first solids stream with a first binary fluid to form a first density separation fluid where the first binary fluid is separate and distinct from the drilling fluid and has a selected design density range that is close to or between the densities of the drill cuttings and the first target recycle material;

(c) separating the first target recycle materials from the non-target solid drill cuttings in a first binary separation step based on density or enhanced mass separation;

(d) directing the first target recycle materials to a first liquid/solid separation step to recover the first target recycle materials and direct collected first binary fluid to a first binary fluid rejuvenation step;

(e) directing the non-target drill cuttings from the first binary separation step to a second liquid/solid separation step for the elimination of the non-target solid drill cuttings and direct collected binary fluid to the first binary fluid rejuvenation step;

(f) rejuvenating the first binary fluid to eliminate contaminants and diluents and direct rejuvenated first binary fluid to the first binary separation step having a density within the selected design density range;

(g) blending the second solids stream with a second binary fluid to form a second density separation fluid where the second binary fluid is separate and distinct from the drilling fluid and has a selected design density range that is close to or between the densities of the drill cuttings and the second target recycle material;

(h) separating the second target recycle materials from the non-target solid drill cuttings in a second binary separation step based on density or enhanced mass separation;

(i) directing the second target recycle materials to a third liquid/solid separation step to recover the second target recycle materials and direct collected second binary fluid to a second binary fluid rejuvenation step;

(j) directing the non-target drill cuttings from the second binary separation step to a fourth liquid/solid separation step for the elimination of the non-target solid drill cuttings and direct collected second binary fluid to the second binary fluid rejuvenation step; and (k) rejuvenating the second binary fluid to eliminate contaminants and diluents and direct rejuvenated second binary fluid to the second binary separation step having a density within the selected design density range.

* * * * *